United States Patent [19]

Vinson

[11] 4,361,353

[45] Nov. 30, 1982

[54] METHOD AND APPARATUS FOR RETRIEVING WEAR BUSHINGS OF VARIOUS DIAMETERS

[75] Inventor: Joe D. Vinson, Morgan City, La.

[73] Assignee: Sub-Surface Tools, Inc., Morgan City, La.

[21] Appl. No.: 181,403

[22] Filed: Aug. 26, 1980

[51] Int. Cl.[3] ..... E21B 23/00; E21B 31/20

[52] U.S. Cl. ..... 294/86.1; 166/181; 285/401; 285/404; 294/86.24; 294/90; 403/348

[58] Field of Search ..... 294/86 R, 86.1, 86.17, 294/86.21-86.26, 86.33, 93-95, 90; 166/85, 123, 181; 285/360, 376, 401, 404; 403/348, 349

[56] References Cited

U.S. PATENT DOCUMENTS

| | | | |
|---|---|---|---|
| 1,505,475 | 8/1924 | Lewis | 294/86.25 X |
| 1,873,621 | 8/1932 | Moore | 285/376 X |
| 2,128,430 | 8/1938 | Pryor | 294/86.21 |
| 2,245,963 | 6/1941 | Crickmer | 285/376 X |
| 2,421,324 | 5/1947 | Graham | 294/93 X |
| 3,072,430 | 1/1963 | Fahrenwald | 294/90 X |
| 3,350,130 | 10/1967 | Ahlstone et al. | 294/90 X |
| 3,392,784 | 7/1968 | Brown | 166/123 |
| 4,050,731 | 9/1977 | Coone et al. | 294/90 X |
| 4,101,070 | 7/1978 | Hoare et al. | 403/348 X |

*Primary Examiner*—Johnny D. Cherry
*Attorney, Agent, or Firm*—Burns, Doane, Swecker & Mathis

[57] ABSTRACT

The present invention relates to a method and apparatus for retrieving wear bushings of various diameters and configurations with a single retrieving tool. The apparatus comprises an elongated member having first and second ends and having a generally cylindrical outer peripheral portion arranged parallel with a longitudinal axis of the elongated member. A plurality of adjustable members are adapted for engagement with a wear bushing. The plurality of adjustable members is selectively variable in quantity dependent upon the configuration of the wear bushing. Each of the adjustable members is arranged at the cylindrical outer peripheral portion of the elongated member and extends outwardly an adjustable distance along an extension of a radius of the cylindrical portion. In a preferred embodiment, the adjustable members comprise bolts which are adjustably secured in tapped holes arranged in the cylindrical portion of the elongated member. In a further preferred embodiment, an annular ring having a cylindrical outer peripheral surface whose diameter is greater than the diameter of the cylindrical outer peripheral portion of the elongated member is fixedly secured between the ends of the elongated member. A further plurality of adjustable members, which plurality is variable in quantity, is arranged at the outer peripheral surface of the annular ring for engagement with a retrieving groove of a larger diameter wear bushing.

17 Claims, 3 Drawing Figures

METHOD AND APPARATUS FOR RETRIEVING WEAR BUSHINGS OF VARIOUS DIAMETERS

BACKGROUND AND SUMMARY OF THE PRESENT INVENTION

The present invention relates to a method and apparatus for inserting and retrieving wear bushings of various diameters in a well head casing.

A wear bushing is provided for a well head casing during drilling operations to protect an upper end of the casing from engagement with the drill bit as the drill bit is lowered or raised through the casing. The wear bushing also prevents contact between the drill pipe sections and the well head casing as the drill pipe sections are rotated during normal rotary drilling operations. By providing the wear bushing, a smooth surface is retained within the well head casing to inhibit leaks from appearing in the casing upon completion of the drilling operations.

The wear bushing, however, must be conveniently able to be removed from the casing for various reasons. For example, the wear bushing may become worn from the action of the continuously rotating drill pipe sections against the wear bushing. Further it is desirable to withdraw the wear bushing to conduct tests to determine whether or not any portion of the casing has been demaged or contains leaks. In addition, it is required by the U.S.G.A. that a test plug be inserted in the well head casing once a week during drilling to test for blowout prevention. In order to insert the test plug in the well head casing, it is necessary to remove the wear bushing.

Various wear bushing retrieving tools have been proposed whose configuration is dependent upon the particular type of wear bushing to be retrieved. One such tool, for use with a wear bushing of the type having vertical access slots on an upper inner peripheral surface of the wear bushing which slots communicate with a retrieving groove arranged around the inner peripheral surface of the wear bushing, consists of a cylindrical member with a number of studs (corresponding to the number of access slots) welded to an outer surface of the cylindrical member. A tool of this type, however, has the disadvantage that it is only useful with a wear bushing of a single diameter. Also, a device of this type has the further disadvantage that if one of the studs breaks off during operation the retrieving tool cannot be easily repaired at the drilling site.

Another known retrieving tool is disclosed in U.S. Pat. No. 3,645,328 issued Feb. 29, 1972 to Greene, Jr. The Greene, Jr. patent relates to a retrieving apparatus comprising a plurality of legs which are held in an inward position by a flange. Upon releasing the flange, the arms move outwardly to engage a lower edge of a wear bushing. An apparatus of the type disclosed in the Greene, Jr. patent is not adaptable for use with a large number of wear bushings having different diameters. Also, a device of this type cannot be repaired easily if one of the legs breaks during a retrieving operation.

U.S. Pat. No. 3,489,214 issued Jan. 13, 1970 to Phipps et al discloses a wear bushing retrieving tool which includes a plurality of fixed pins which engage and withdraw a wear bushing. The tool in the Phipps et al patent comprises a sleeve which is placed over a drill pipe section and held in place by a pair of screws. A tool of this type, however, cannot be adapted to retrieve wear bushings of various diameters.

U.S. Pat. No. 3,473,608 issued Oct. 21, 1969 to Castille discloses a retrieving tool having a plurality of spring biased arms which engage an upturned groove provided on an inner wall of a wear bushing. The outward movement of the arms is limited by a stop which also provides additional support for the arms as the wear bushing is lifted from a well head casing. There is no disclosure in the Castille patent of providing a plurality of adjustable members which allow the effective diameter of a retrieving tool to be varied to retrieve wear bushings of various diameters. Also, a device of the type disclosed in the Castille patent is complex and is difficult to repair at the drilling site in the event of breakage of the tool.

Accordingly, it is an object of the present invention to provide a wear bushing retrieving method and apparatus which is simple in construction and operation yet is adaptable to retrieve wear bushings having a large range of different diameters.

A further object of the present invention is to provide a retrieving tool which can be easily adjusted or repaired in case of breakage at the site of the drilling.

It is still a further object of the present invention to provide a retrieving tool which is useful with wear bushings of several different configurations. Another object of the present invention is to provide a retrieving tool which is adjustable to retrieve wear bushings having various diameters and configurations without requiring the use of any special tools or knowledge.

A further object of the present invention is to provide a method for adapting a single retrieving tool for retrieving wear bushings having various different inside diameters.

These and other objects of the present invention are accomplished by a wear bushing retrieving tool comprising an elongated member having first and second ends. The elongated member includes a generally cylindrical outer peripheral portion arranged parallel to a longitudinal axis of the elongated member. A plurality of adjustable members adapted for engaging a wear bushing are arranged at the cylindrical outer peripheral portion of the elongated member. Each of the adjustable members extends outwardly from the cylindrical portion an adjustable distance generally along a radius of the cylindrical portion. In addition, the plurality of adjustable members is selectively variable in quantity.

In a preferred embodiment, each of the adjustable members comprises a bolt which is screwed into a respective tapped hole in the cylindrical outer peripheral portion. Each of the bolts can be easily adjusted to any effective diameter which is determined by the diameter of the wear bushing to be retrieved. It is also preferred to provide a plurality of washers which maintain a head of each of the bolts at a desired outward distance from the cylindrical portion. The retrieving tool of the present invention also includes a plurality of tapped holes in the cylindrical portion of the elongated member such that the retrieving tool of the present invention can be adapted for use in retrieving wear bushings having various numbers of access solts communicating with a retrieving groove on an inside surface of the wear bushing.

A further preferred embodiment of the present invention includes an annular ring which has an opening in the center thereof which opening is adapted to slide over the elongated member of the retrieving tool. The annular ring is secured intermediate the ends of the elongated member and includes a generally cylindrical outer peripheral surface which has a diameter which is larger then the diameter of the cylindrical outer peripheral portion of the elongated member. A plurality of adjustable members are provided in the outer peripheral surface of the annular ring. In this way, a single retrieving tool can be adapted for use with a larger range of diameters of wear bushings.

A method for adapting a single wear bushing retrieving tool for retrieving wear bushings of various different inside diameters according to the present invention comprises selecting a quantity of adjustable members to correspond with a number of access slots in a wear bushing to be retrieved. An end of each of the selected quantity of adjustable members is inserted in an appropriate bore in a first cylindrical outer peripheral surface of the single retrieving tool. Each of the selected quantity of adjustable members is adjusted within the openings such that the effective diameter of the adjustable members is slightly less than an inside diameter of a retrieving groove in the wear bushing.

BRIEF DESCRIPTION OF THE DRAWINGS

Preferred embodiments of a method and apparatus for retrieving wear bushings of various diameters according to the present invention will be described with reference to the accompanying drawings wherein like members bear like reference numerals and wherein.

DETAILED DESCRIPTION OF THE PREFERRED EMBODIMENTS

Figure 1:
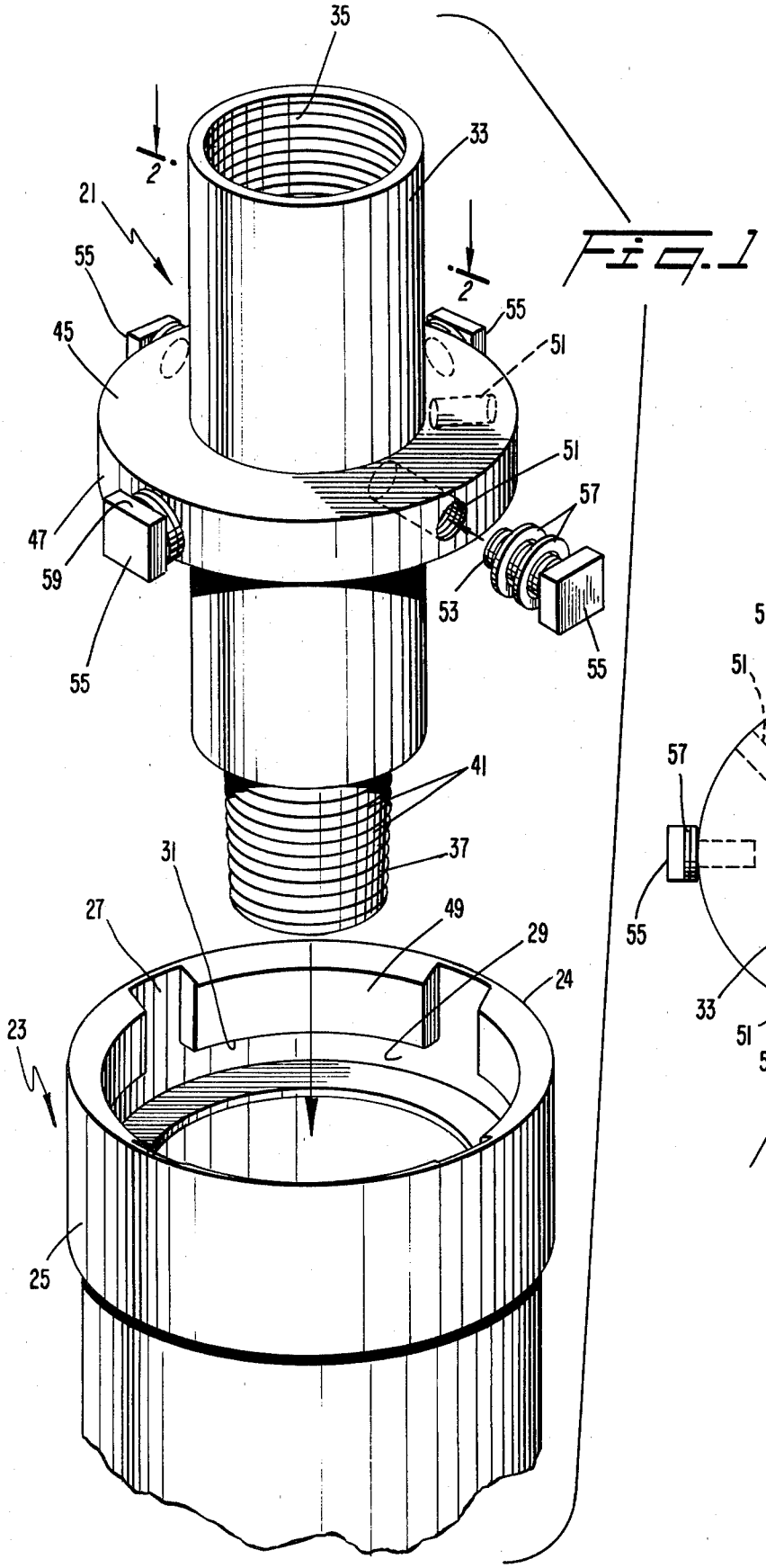
FIG. 1 is a perspective view of a wear bushing retrieving tool according to the present invention and a wear bushing.

With reference to FIG. 1, a wear bushing retrieving tool 21 according to the present invention is adapted to insert and to remove a wear bushing 23. The wear bushing 23 comprises a generally cylindrical body member 25 which is dimensioned to fit within a well head casing (not shown) to protect the well head casing from contact with a rotating drill pipe in conventional fashion. On an inside peripheral surface of the cylindrical member 25, a plurality of access slots 27 generally parallel to a longitudinal axis of the cylindrical member 25 are provided which extend from an edge 24 of the cylindrical member 25 and open into a retrieving groove 29 arranged circumferentially around the inside peripheral surface of the cylindrical body member 25.

An inside surface 31 of the groove 29 adjacent the access slots 27 presents a generally flat surface which extends at approximately a 90° angle with respect to the longitudinal axis of the cylindrical member 25. The surface 31 is provided to present an abutment which is engaged by portions of the wear bushing retrieving tool 21 to permit lowering and raising of the wear bushing 23 from the well head casing.

While the illustrated wear bushing 23 includes four access slots 27, it is to be understood that the wear bushing 23 may be provided with various numbers of slots dependent upon the diameter and weight of the wear bushing 23 as well as the thickness of the wall of the cylindrical member 25. A minimum of two access slots 27 is required in order for the retrieving tool 21 to be able to raise and lower the wear bushing 23 while still preventing skewing of either the wear bushing 23 or the retrieving tool 21 as the wear bushing is being inserted or retrieved. Additional access slots 27 as desired may be provided. In a typical range of diameters and weights of wear bushings, the typical number of access slots is three or four. It should also be noted that the wear bushing 23 can be of any of the usual industry taper arrangements. The wear bushing 23 could, for example, be either a 45° or 8° taper which tapers are the typical industry standards.

Figure 3:
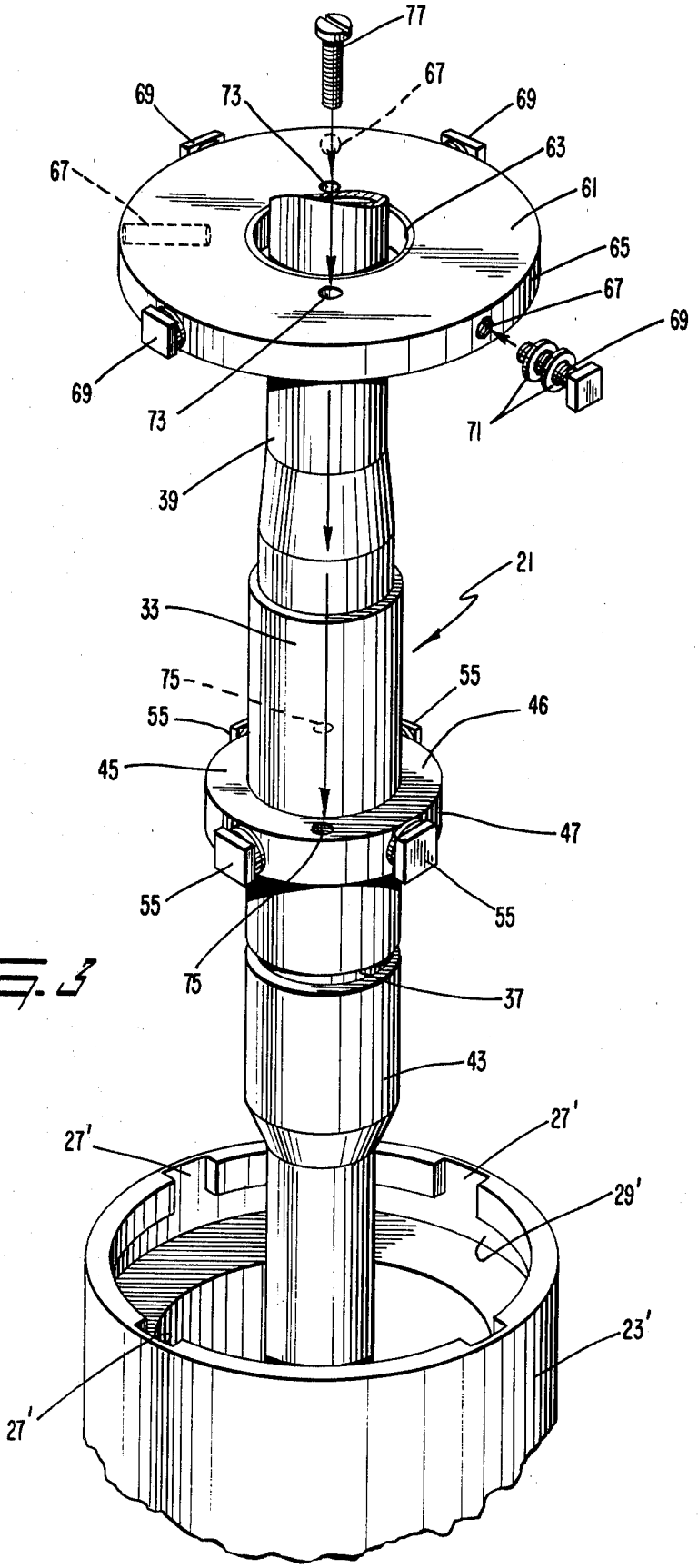
FIG. 3 is a perspective view of the wear bushing retrieving tool attached to drill pipe sections and including an annular ring according to the present invention.

The wear bushing retrieving tool 21 of the present invention includes a generally cylindrical elongated body member 33 which preferably has an axial bore along its entire length. Internal threads 35 are arranged at a first end of the elongated member 33 which threads 35 are adapted to engage an end of a first drill pipe section 39 (FIG. 3). At a reduced diameter section 37 at a second end of the elongated member 33, external threads 41 are provided which external threads 41 are adapted to engage an end of a second drill pipe section 43 (FIG. 3). As seen in FIG. 3, when the first and second drill pipe sections 39,43 are secured to the wear bushing retrieving tool 21 of the present invention, the retrieving tool 21 can be raised and lowered by a conventional drive (not shown) for the drill pipe sections for engagement with the wear bushing 23 as described in more detail below. Also, by including the external threads 41, all of the pipe sections which penetrate into the well do not have to be removed in order to employ the wear bushing retrieving tool 21 to remove the wear bushing 23 for replacement of the wear bushing 23 or for testing of the well head casing. In other words, the external threads 41 hold the lower pipe sections when the wear bushing retrieving tool 21 is being utilized.

The elongated member 33 includes a generally cylindrical outer peripheral portion arranged along at least a segment of the length of the elongated member 33 which portion is parallel to a longitudinal axis of the elongated member 33.

In a preferred embodiment with reference to FIG. 1, the elongated member 33 includes an annular collar 45 arranged intermediate the first and second ends of the elongated member 33. The elongated member 37 and the annular collar may be formed as a single unit. Alternatively, the annular collar 45 may be secured to an outer peripheral surface of the elongated member 33 by any suitable connection, e.g., welding. The annular collar 45 is arranged perpendicularly to the longitudinal axis of the elongated member 33 and the generally cylindrical outer peripheral portion of the elongated member 33 is the outer peripheral surface 47 of the annular collar 45. In the preferred embodiment, the center of the cylindrical surface 47 coincides with the longitudinal axis of the elongated member 33. Alternatively, the cylindrical outer peripheral surface 47 of the annular collar 45 could be arranged as an integral, generally cylindrical portion of the outer peripheral surface of the elongated member 33, provided that the generally cylindrical portion of the outer peripheral surface of the elongated member 33 is parallel to and extends radially outwardly from the axis of the elongated member 33 at least as far as remaining portions of the outer peripheral surface of the elongated member 33 which pass through the wear bushing 23.

The diameter of the cylindrical outer surface 47 is less than the diameter of the portions 49 of the wear bushing 23 which portions 49 are disposed between adjacent access slots 27 of the wear bushing 23. In this way, the annular collar 45 can easily pass through the wear bushing 23 over a portion of the length of the wear bushing 23 which portion is at least equal to the distance from the edge 24 of the wear bushing to the retrieving groove 29.

Figure 2:
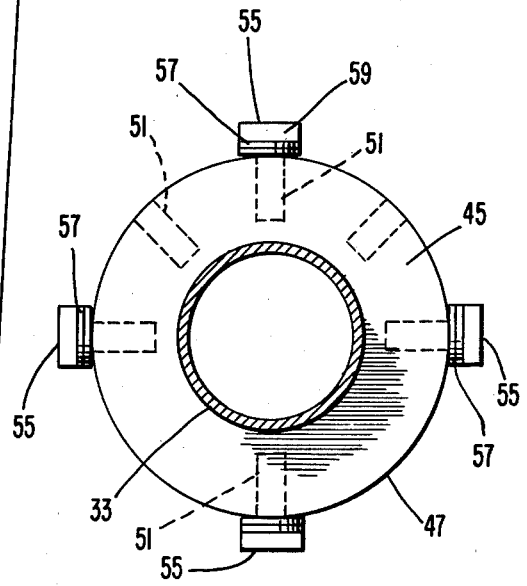
FIG. 2 is a view of the wear bushing retrieving tool along the line 2—2 in FIG. 1.

The outer peripheral surface 47 of the annular collar 45 is provided with a plurality of tapped holes 51 (FIG. 2) which are arranged in a common plane which is perpendicular to the longitudinal axis of the elongated member 33. Each of the tapped holes 51 extends generally along a radius of the outer peripheral surface 47. In a preferred embodiment, five tapped holes 51 are provided in the outer peripheral surface 47 of the annular collar 45. The tapped holes 51 are arranged sequentially at locations corresponding to 0°, 60°, 90°, 180°, 270° and 300°. In this way, three of the holes 51 present equal spacing of 120° between each of the tapped holes 51 and four of the holes 51 present equal spacing of 90° between each of the tapped holes 51.

A plurality of adjustable bolts 53 having preferably square heads 55 are provided with each of the bolts 53 being adapted to be secured in an appropriate tapped hole 51 in the outer peripheral surface 47 of the annular collar 45. The heads 55 of the bolts 53 are preferably square in order to provide as large a surface area as possible to engage the inside surface 31 of the retrieving groove 29 in the wear bushing 23. The radial width and the thickness of the collar 45 lend strength for securely holding the bolts 53 in the tapped holes 51.

The number of bolts 53 which are secured in the tapped holes 51 is selectively variable and is dependent upon the number of access slots 27 provided in a wear bushing 23 which is to be retrieved. In other words, by providing adjustable, removable bolts 53 which are adapted to engage the inside surface 31 of the retrieving groove 29 of the wear bushing 23, the wear bushing retrieving tool 21 of the present invention can be adapted to retrieve wear bushings having two, three, four or more access slots 27. By properly selecting the quantity of adjustable bolts 53 and properly selecting the appropriate holes 51 into which each of the bolts 53 is secured, the wear bushing retrieving tool 21 can be adapted to be used on wear bushings having various numbers of access slots 27.

In addition, by providing adjustable bolts 53 for engaging the inside surface 31 of the groove 29 in the wear bushing 23, the effective diameter of the wear bushing retrieving tool 21 can be easily adjusted. By adjusting the radially outward extension of the heads 55 of each of the bolts 53 along a corresponding radius of the outer peripheral surface 47, the wear bushing retrieving tool 21 of the present invention can be adapted for use with various wear bushings 23 of various different diameters. In order to secure the bolts in the proper predetermined radially outward location a suitable plurality of washers 57 may be provided to limit the radially inward movement of the bolts 53. Also, the present invention can be adapted to retrieve wear bushings having various different widths for the retrieving groove 29 in the wear bushing 23 by inserting a bolt 53 having a head 55 of the appropriate dimension.

A further advantage derived from using adjustable removable bolts 53 to engage the inside surface 31 of the retrieving groove 29 in the wear bushing 23 is that if a head 55 of a bolt 53 should shear off (an event which could occur during use of the retrieving tool at the site of drilling operations), the broken bolt 53 can be easily removed and a new bolt quickly inserted with conventional tools. The quick replacement and adjustment of the bolts 53, which engage the retrieving groove 29 in the wear bushing 23, permit the main portion, e.g., the elongated member 33 and the annular collar 45 having tapped holes 51, of a single retrieving tool 21 to be continuously utilized even when the diameters of the wear bushings vary. In other words, time is not wasted locating a wear bushing retrieving tool of the appropriate size or waiting for special tools or skills to repair a retrieving tool which has broken at the drilling site.

In operation of the present invention, an appropriate quantity of adjustable bolts 53 is selected dependent upon the number of access slots 27 in the wear bushing 23 to be retrieved. Each of the selected quantity of bolts 53 is inserted into an appropriate tapped hole 51 in the outer peripheral surface 47 dependent upon the spacing between the access slots 27. Each of the bolts 53 is adjusted along a corresponding radius of the outer peripheral surface 47 of the wear bushing retrieving tool 21 until the effective diameter of the heads 55 of the bolts 53 is just slightly less than the inside diameter of the retrieving groove 29 in the wear bushing 23 and is greater than the diameter of the portions 49 between the access slots 27. An appropriate number of spacer washers 57 may be provided an necessary on each of the bolts 53 to hold the bolts 53 at the appropriate radially extended location and to increase the stability of the bolts 53 when the heads 55 engage the surface 31 of the retrieving groove 29.

A portion of the drill string is preferably withdrawn by a suitable mechanism (not shown) from the well and the first drill pipe section 39 is separated from the second drill pipe section 43. The first end of the wear bushing retrieving tool 21 of the present invention is then secured to the first drill pipe section 39 by the internal threads 35 and the second drill pipe section 43 is secured to the external threads 41 at the second end of the elongated member 33 of the wear bushing retrieving tool 21. The wear bushing retrieving tool 21 is then lowered along with the drill pipe sections 39, 43 by a suitable mechanism into the wear bushing 23 arranged in the well head casing such that each of the heads 55 of the bolts 53 aligns with a respective one of the access slots 27 in the inside peripheral surface of the cylindrical body member 25 of the wear bushing 23. The drill pipe sections 39, 43 are then further lowered into the well until the heads 55 of the bolts 53 abut a lower inside surface of the retrieving groove 29.

The drill pipe sections 39, 43 are then rotated slightly by hand or another suitable mechanism until the heads 55 of the bolts 53 slide inside the retrieving groove 29 beneath the portions 49 along the peripheral surface of the wear bushing 23. Thereafter, the drill pipe sections 39, 43 are withdrawn by the suitable mechanism and an edge surface 59 on each of the heads 55 of the bolts 53 engages the inside surface 31 of the retrieving groove 29 in the wear bushing 23 to lift the wear bushing 23 upwardly out of the well head casing. When the wear bushing 23 has cleared an upper surface of the well head casing, the wear bushing 23 and the wear bushing retrieving tool 21 of the present invention are removed and an appropriate plug is inserted in the well head casing or another testing operation may be undertaken. The operation of the present invention is essentially reversed when it is desired to insert the wear bushing 23 into the well head casing.

With reference to FIG. 3, an annular ring 61 is provided to adapt the wear bushing retrieving tool 21 of the present invention to wear bushings 23' having various larger diameters. The annular ring 61 has an opening 63 in the center of the ring 61 whose inside diameter is slightly larger than the diameter of the elongated member 33. The annular ring 61 also includes a generally cylindrical outer peripheral surface 65 whose diameter is greater than the diameter of the outer peripheral surface 47 of the annular collar 45 by an amount which is greater than the maximum radially outward adjustment permitted by the bolts 53 in the peripheral surface 47 of the annular collar 45. In other words, the outer peripheral surface 65 of the ring 61 has a diameter which is greater than the maximum effective diameter which can be achieved when the bolts 53 are secured in the holes 51 in the annular collar 45.

A second plurality of tapped holes 67 are provided in the outer peripheral surface 65 of the annular ring 61. The number of such tapped holes 67, as in the case of the tapped holes 51, is selected to permit the wear bushing retrieving tool 21 with the annular ring 61 secured thereon to engage wear bushings having various numbers of access slots 27'. A second plurality of adjustable bolts 69 similar to the bolts 53, is provided which bolts 69 are adapted to engage the tapped holes 67. A plurality of spacer washers 71 may also be provided on each of the second plurality of bolts 69 to limit the radially inward movement of each of the bolts 69.

At least two tapped bores 73 are provided near the central opening 63 in the ring 61 and extend through the annular ring 61 generally parallel to a longitudinal axis of the ring 61. A pair of tapped holes 75 provided in an upper surface 46 of the annular collar 45 selectively align with the tapped bores 73 in the annular ring 61. In this way, as can be seen in FIG. 3, the elongated member 33 can be inserted into the central opening 63 in the ring 61 such that the tapped bores 73 in the ring 61 align with the tapped holes 75 in the upper surface 46 of the annular collar 45 and a pair of bolts 77 (only one bolt being illustrated in FIG. 3) can be passed through the bores 73 and releasably secured in the tapped holes 75 to fix the annular ring 61 to the annular collar 45 intermediate the ends of the elongated member 33.

The annular ring 61 adapts the wear bushing retrieving tool 21 of the present invention to a much larger variety of wear bushings of different diameters. In addition, by providing an annular ring 61, in lieu of providing longer bolts 53 in the outer peripheral surface 47 of the annular collar 45, the strength and reliability of the wear bushing retrieving tool 21 of the present invention is improved. By providing the annular collar 61, the radially outward extension of the bolts 53 can be limited to a shorter distance. This limited extension of the bolts 53 outwardly from the outer peripheral surface 47 of the annular collar 45 is desirable since breakage of the bolts 53 is much less likely to occur. If the bolts 53 are extended a great distance outwardly from the outer peripheral surface 47 of the collar 45, the weight of the wear bushing is more likely to shear off the heads 55 of the bolts 53. By employing the annular ring 61, the extension of the bolts 69 secured in the tapped holes 67 in the outer peripheral surface 65 of the annular ring 61 is much less than that required of the bolts 53 in the outer peripheral surface 47 of the annular collar 45 to engage the larger diameter wear bushing 23'. Hence, the strength of the bolts 53 is enhanced.

It should be noted that each of the other adjustable features discussed with reference to the bolts 53 in the outer peripheral surface 47 of the collar 45 are applicable to the bolts 69 in the outer peripheral surface 65 of the annular ring 61.

The principles and preferred embodiments of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the appended claims be embraced thereby.

What is claimed is:

1. A wear bushing retrieving tool for use in removing wear bushings of different diameters, said wear bushings including slot means for engaging a portion of the retrieving tool, said tool comprising:

an elongated member having first and second ends;

said elongated member having a generally cylindrical outer peripheral portion arranged along at least a segment of the length of the elongated member which cylindrical portion is parallel to and extends radially outwardly from a longitudinal axis of the elongated member; and a plurality of adjustable means adapted for engaging slot means provided in a wear bushing, said plurality being selectively variable in quantity, each of said adjustable means being arranged at the cylindrical outer peripheral portion of the elongated member, each of said adjustable means having an adjustable outward extension from the cylindrical outer peripheral portion generally along an extension of a radius of the cylindrical portion, the outward extension of each of said adjustable means being adjustable prior to a single use of the tool between a location closely adjacent the cylindrical portion and a location spaced from the cylindrical portion such that the effective diameter of the plurality of adjustable means corresponds to the diameter of the slot means of the wear bushing to be retrieved, said outward extension of the adjustable means being greater than an outward extension of any portion of the tool cooperating with the wear bushing and being a predetermined fixed distance which is substantially invariable during the signle use of the retrieving tool.

2. The wear bushing retrieving tool of claim 1 further comprising:

a plurality of openings in the cylindrical portion of the elongated member, said plurality of openings lying in a single plane perpendicular to the longitudinal axis of the elongated member; and each of said adjustable means being arranged in one of the plurality of openings.

3. The wear bushing retrieving tool of claim 2 wherein the plurality of openings is six with the six openings being spaced apart such that four of the openings are arranged to present 90° spacing between each of the four openings and three of the openings are arranged to present 120° spacing between each of the three openings.

4. The wear bushing retrieving tool of claims 1 or 3 further comprising spacer means for holding an end of each of said adjustable means at the predetermined distance from the cylindrical outer peripheral portion.

5. The wear bushing retrieving tool of claim 2 wherein the plurality of openings are tapped holes and each of the adjustable means comprises a bolt threadedly engaging one of the tapped holes.

6. The water bushing retrieving tool of claim 1 wherein the quantity of adjustable means in said plurality is two.

7. The wear bushing retrieving tool of claim 1 further comprising:

an annular ring having a central opening adapted to receive the elongated member;

the annular ring having a generally cylindrical outer peripheral surface whose diameter is greater than the diameter of the cylindrical outer peripheral portion of the elongated member; and fastening means for securing the annular ring intermediate the first and second ends of the elongated member.

8. The wear bushing retrieving tool of claim 7 wherein the annular ring includes a further plurality of adjustable means adapted for engaging a wear bushing, said further plurality being selectively variable in number, each of said further plurality of adjustable means being arranged at the cylindrical outer peripheral surface of the annular ring and extending outwardly from the cylindrical outer peripheral surface of the annular ring an adjustable distance generally along a radius of the cylindrical outer peripheral surface of the annular ring.

9. The wear bushing retrieving tool of claim 7 wherein the opening in the annular ring has a diameter which is less than the diameter of the outer peripheral portion of the elongated member and wherein the fastening means comprises a plurality of bolts passing through an equal plurality of bores through the annular ring generally parallel with a longitudinal axis of the annular ring, each of said bolts being selectively secured in an aligned tapped hole in a radially extending surface of an annular collar which carries the outer peripheral portion of the elongated member.

10. The wear bushing retrieving tool of claim 1 wherein the cylindrical outer peripheral portion of the elongated member is arranged on an annular collar secured to the elongated member intermediate the ends of the elongated member.

11. The wear bushing retrieving tool of claim 1 wherein the first end of the elongated member includes internal threads and the second end of the elongated member includes external threads.

12. A wear bushing retrieving tool for retrieving wear bushings having various different diameters an including access slots communicating with a retrieving groove, said retrieving tool comprising:

an elongated member having first and second ends;

an annular collar fixedly arranged intermediate the first and second ends, said collar having a generally cylindrical outer peripheral surface which is parallel to a longitudinal axis of the elongated member;

a plurality of openings in the outer peripheral surface, said openings lying in a single plane perpendicular to the longitudinal axis of the elongated member and extending along radii of the cylindrical outer peripheral surface; and a plurality of bolts adapted for engaging a retrieving groove of a wear bushing, said plurality of bolts being selectively variable in quantity, each of said bolts being arranged in an appropriate one of the plurality of openings, a head of each of said bolts having an adjustable outward extension from the outer peripheral surface of the collar along an extension of the radius of the respective opening, the outward extension of each of said bolts being adjustable prior to a single use of the tool between a location closely adjacent the cylindrical portion and a location spaced from the cylindrical portion such that the effective diameter of the plurality of bolts corresponds to the diameter of the retrieving groove of the wear bushing to be retrieved, said outward extension of the bolts being greater than an outward extension of any portion of the tool cooperating with the wear bushing and being a predetermined fixed distance which is substantially invariable during the single use of the retrieving tool.

13. A method of adjusting a single retrieving tool for retrieving wear bushings having various inside diameters, the wear bushings being of the type having a plurality of access slots parallel to a longitudinal axis of the wear bushing which slots communicate with an annular retrieving groove perpendicular to the access slots on an inside surface of the wear bushing, comprising the steps of:

selecting a quantity of adjustable members, which quantity corresponds in number with the quantity of access slots in a wear bushing to be retrieved;

inserting an end of each of the selected quantity of adjustable members into an appropriate one of a plurality of openings in a first cylindrical outer peripheral surface of the single retrieving tool;

permitting adjustment of the outward extension of said adjustable members prior to a single use of the tool between a first location closely adjacent the first cylindrical surface and a second location spaced from the first cylindrical portion; and fixedly adjusting each of the selected quantity of adjustable members within the appropriate one of the openings prior to the single use of the retrieving tool such that the effective diameter of the adjustable members is fixed at a value slightly less than an inside diameter of the retrieving groove in the wear bushing to be retrieved, said outward extension being greater than an outward extension of any portion of the tool cooperating with the wear bushing and being substantially invariable during the single use of the retrieving tool.

14. The method of claim 13 further comprising the step of inserting spacers between free ends of each of the adjustable members and the first outer cylindrical surface to hold the adjustable members at the appropriate effective diameter.

15. The method of claim 13 further comprising the steps of:

attaching an annular ring to the single retrieving tool, the annular ring including a second cylindrical outer peripheral surface having a diameter greater than the diameter of the first cylindrical outer peripheral surface; and inserting an end of each of a selected quantity of adjustable members into an appropriate one of a plurality of openings in the second cylindrical outer peripheral surface.

16. The wear bushing retrieving tool of claim 1, wherein the quantity of adjustable means in said plurality is three.

17. The wear bushing retrieving tool of claim 1, wherein the quantity of adjustable means in said plurality is four.

* * * * *